US010954102B2

(12) United States Patent
Yamada et al.

(10) Patent No.: US 10,954,102 B2
(45) Date of Patent: Mar. 23, 2021

(54) DIAGNOSTIC STEP FOR A PASSENGER CONVEYOR

(71) Applicant: OTIS ELEVATOR COMPANY, Farmington, CT (US)

(72) Inventors: Atsushi Yamada, Narita (JP); Hiromitsu Miyajima, Inzai (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 627 days.

(21) Appl. No.: 15/416,182

(22) Filed: Jan. 26, 2017

(65) Prior Publication Data

US 2018/0208441 A1 Jul. 26, 2018

(51) Int. Cl.
*B66B 23/12* (2006.01)
*B66B 25/00* (2006.01)

(52) U.S. Cl.
CPC ..... *B66B 23/12* (2013.01); *B66B 25/006* (2013.01)

(58) Field of Classification Search
CPC ..... B66B 23/12; B66B 25/006; B66B 29/005; B65G 2207/04
See application file for complete search history.

(56) References Cited

U.S. PATENT DOCUMENTS

| | | | | |
|---|---|---|---|---|
| 5,353,907 | A | 10/1994 | Ogimura et al. | |
| 7,334,672 | B2 | 2/2008 | Sheehan et al. | |
| 7,857,115 | B2 | 12/2010 | Lebrecque et al. | |
| 8,960,407 | B2 | 2/2015 | Braasch et al. | |
| 9,346,654 | B2 | 5/2016 | Goldstein | |
| 9,475,676 | B2 | 10/2016 | Ischganeit et al. | |
| 2010/0094798 | A1 | 4/2010 | Shudo et al. | |
| 2016/0152416 | A1 * | 6/2016 | Staab | B65G 23/00 73/865.8 |
| 2016/0236911 | A1 | 8/2016 | Anquan et al. | |

FOREIGN PATENT DOCUMENTS

| | | | |
|---|---|---|---|
| CA | 2447967 | C | 1/2014 |
| CN | 2683615 | Y | 3/2005 |
| CN | 201250044 | Y | 6/2009 |
| CN | 101734545 | A | 6/2010 |
| CN | 203411222 | U | 1/2014 |
| CN | 104210928 | A | 12/2014 |
| EP | 1634843 | A2 | 3/2006 |
| EP | 2716589 | A1 | 4/2014 |
| JP | H07133088 | A | 5/1995 |
| JP | 2000159470 | A * | 6/2000 |

(Continued)

OTHER PUBLICATIONS

European Search Report for application EP 18153256.5, dated Oct. 16, 2018, 10 pages.

(Continued)

*Primary Examiner* — Moshe Wilensky
(74) *Attorney, Agent, or Firm* — Cantor Colburn LLP

(57) ABSTRACT

A diagnostic step for a passenger conveyor comprises at least one camera for shooting at least one lateral side of the interior space of the passenger conveyor, at least one directional microphone pointed to said at least one lateral side of the interior space of the passenger conveyor and an analyzer unit which receives image data from the camera and sound data from the directional microphone and transmits the data to an outside network.

11 Claims, 9 Drawing Sheets

(56) References Cited

FOREIGN PATENT DOCUMENTS

| | | | | |
|---|---|---|---|---|
| JP | 2004224560 | A | * | 8/2004 |
| JP | 2004224560 | A | | 8/2004 |
| JP | 2009012891 | A | | 1/2009 |
| JP | 4791093 | B2 | * | 10/2011 |
| JP | 2015202915 | A | | 11/2015 |

OTHER PUBLICATIONS

European Search Report for Application No. 18153256.5; dated Oct. 30, 2020; 8 Pages.

* cited by examiner

DIAGNOSTIC STEP FOR A PASSENGER CONVEYOR

BACKGROUND

This invention generally relates to passenger conveyors. More particularly, this invention relates to a diagnostic device which facilitates determining the cause of failure or malfunctions associated with a passenger conveyor.

Passenger conveyors, such as escalators, typically include a plurality of steps that travel around a loop for carrying passengers between landings, which may be located at different levels of a building. Occasionally, there is a need for maintenance or repair of the escalator.

During maintenance or repair, operating sounds are usually checked to determine if the escalator is operating in a normal condition. If there are any abnormal sounds, a conventional maintenance or repair process will involve making an educated guess of the components causing the sounds, and removing a plurality of steps from the escalator to gain access to a space beneath the steps to visually check such components in order to determine the cause of failure or malfunctions associated with the escalator.

This process is both time-consuming and labor-intensive since it is difficult to pin point the components causing the sounds due to sound reverberations in the interior space of the escalator and since visual checks need to be done after shutting down the escalator and removing steps there from. The process also involves the risk of maintenance personnel being injured.

In view of the above and other considerations, there is a need for a diagnostic device which facilitates determining the cause of failure or malfunctions associated with a passenger conveyor.

BRIEF SUMMARY

According to one embodiment of the invention, a diagnostic step for a passenger conveyor comprises at least one camera for shooting at least one lateral side of the interior space of the passenger conveyor, at least one directional microphone pointed to said at least one lateral side of the interior space of the passenger conveyor and an analyzer unit which receives image data from the camera and sound data from the directional microphone and transmits the data to an outside network.

According to another embodiment of the invention, a method for performing maintenance or repair of a passenger conveyor using a diagnostic step comprising at least one camera and at least one directional microphone comprises removing a step from a passenger conveyor and installing the diagnostic step in place of the removed step, collecting image data from the camera of at least one lateral side of the interior space of the passenger conveyor while the passenger conveyor is operating, collecting sound data from the directional microphone of said at least one lateral side of the interior space of the passenger conveyor while the passenger conveyor is operating and transmitting the image data and the sound data to an outside network.

The detailed description explains embodiments of the invention, together with advantages and features, by way of example with reference to the drawings.

DETAILED DESCRIPTION

Figure 1:
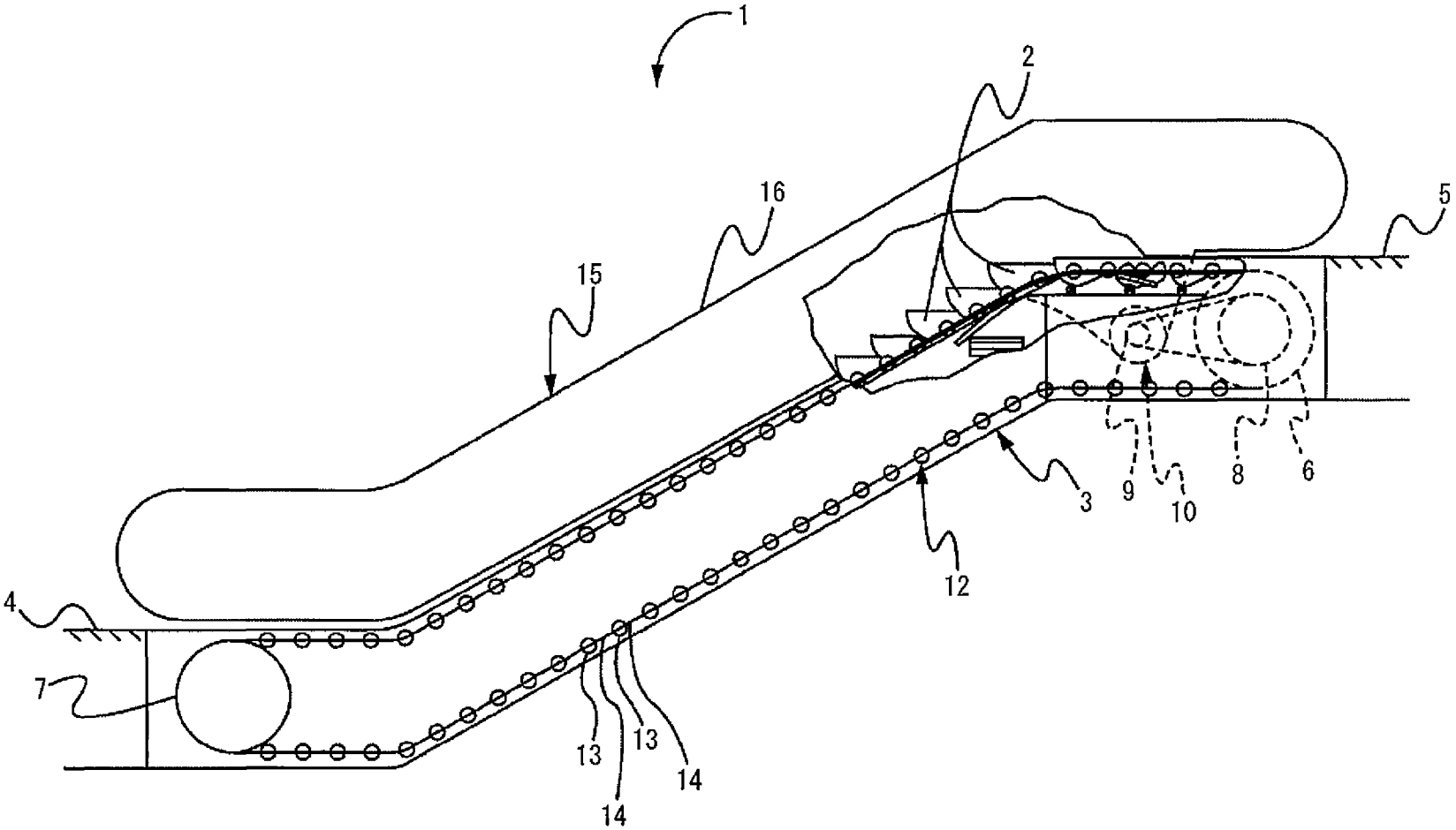
FIG. 1 is a cross-sectional diagram of an escalator.

FIG. 1 schematically shows a passenger conveyer 1 in which the diagnostic device of the present invention may be used. In this example, the passenger conveyor 1 is an escalator including a plurality of escalator steps 2 that travel around a loop for carrying passengers between landings at different levels within a building.

The example passenger conveyor 1 of FIG. 1 comprises a truss 3 installed between a lower landing 4 and an upper landing 5. A first sprocket wheel 6 is rotatably supported at an upper end of the truss 3 and a second sprocket wheel 7 is rotatably supported at a lower end of the truss 3. A drive system (not shown) rotates the first sprocket wheel 6 as well as a handrail drive sprocket 8. The handrail drive sprocket 8 is coupled to a pulley 9 which forms part of a handrail drive system 10.

The escalator steps 2 are coupled to a step chain 12 which may include a plurality of rollers 13 connected by a plurality of links 14. The step chain 12 and the escalator steps 2 are driven by the drive system via the first sprocket wheel 6. A typical step chain 12 includes a pair of parallel endless loops on both lateral sides of the escalator steps 2. The loops are connected together by transverse axles (not shown) that pass between and help support the escalator steps 2. Thus, while only a single loop is illustrated in FIG. 1, it will be understood that the escalator includes dual loops, and each step chain 12 is driven around respective sprocket wheels 6, 7 positioned in the interior space of the truss 3 on each lateral side thereof.

An endless handrail 15 passes around a balustrade assembly 16. While only a single handrail 15 is illustrated in FIG. 1, it will be understood that a pair of endless handrails 15 are supported on a respective balustrade assembly 16 on both lateral sides of the escalator steps 2 and are each driven by a respective handrail drive system 10 positioned in the interior space of the truss 3 on each lateral side thereof.

Figure 2:
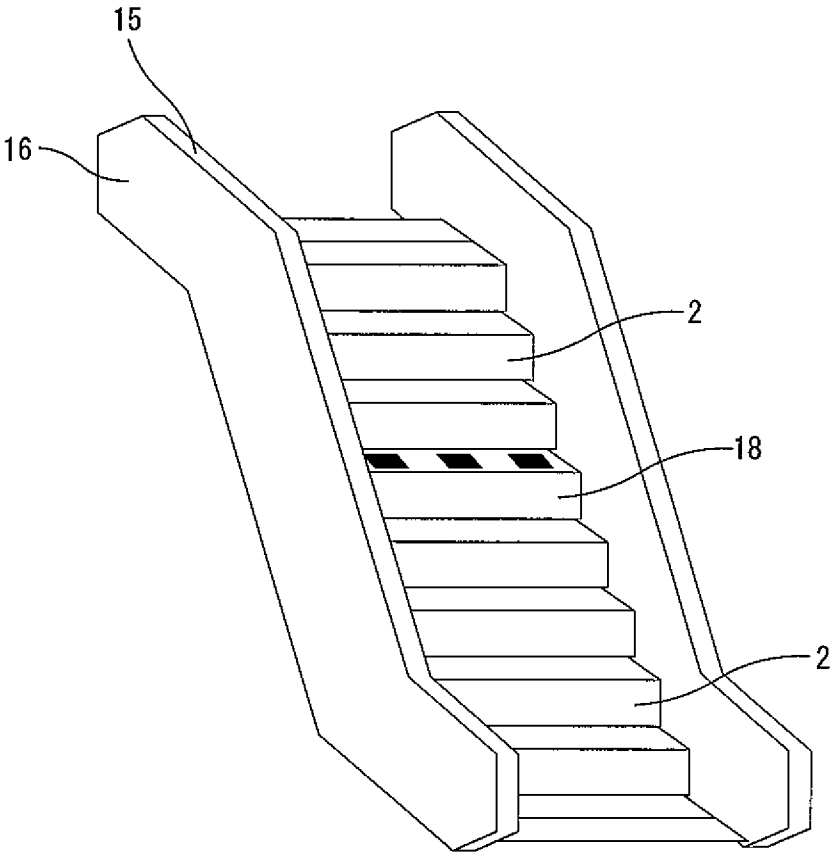
FIG. 2 is a schematic view of an escalator with the diagnostic step of the present invention installed thereon.

FIG. 2 shows an example diagnostic device 18 of the present invention in the form of a step. The diagnostic step 18 may be simply installed on the escalator during maintenance or repair by removing a single escalator step 2 and attaching the diagnostic step 18 in place of the removed escalator step 2.

Figure 3:
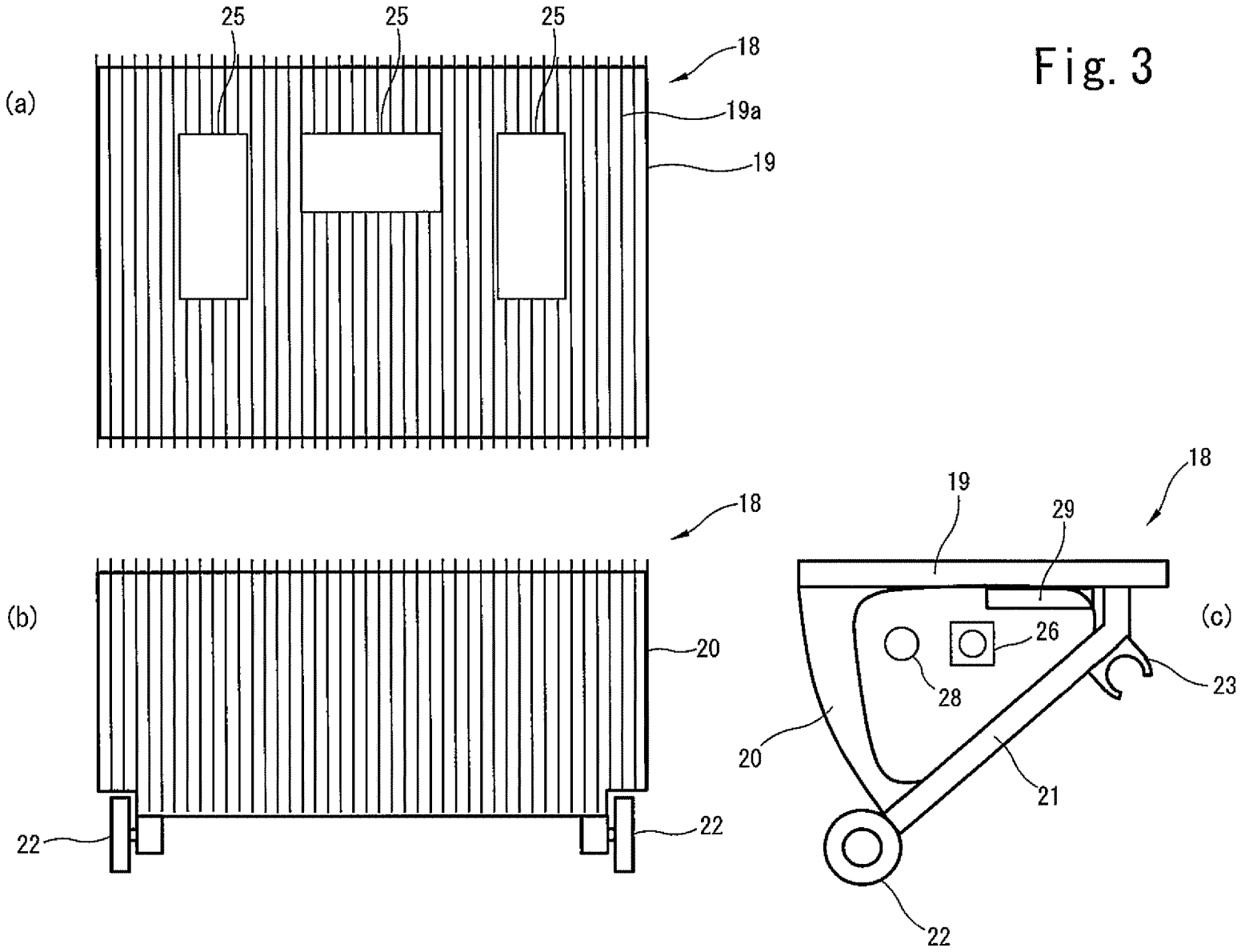
FIG. 3(*a*) is a plan view, FIG. 3(*b*) is a front view and FIG. 3(*c*) is a side view of the diagnostic step of FIG. 2.
Figure 4:
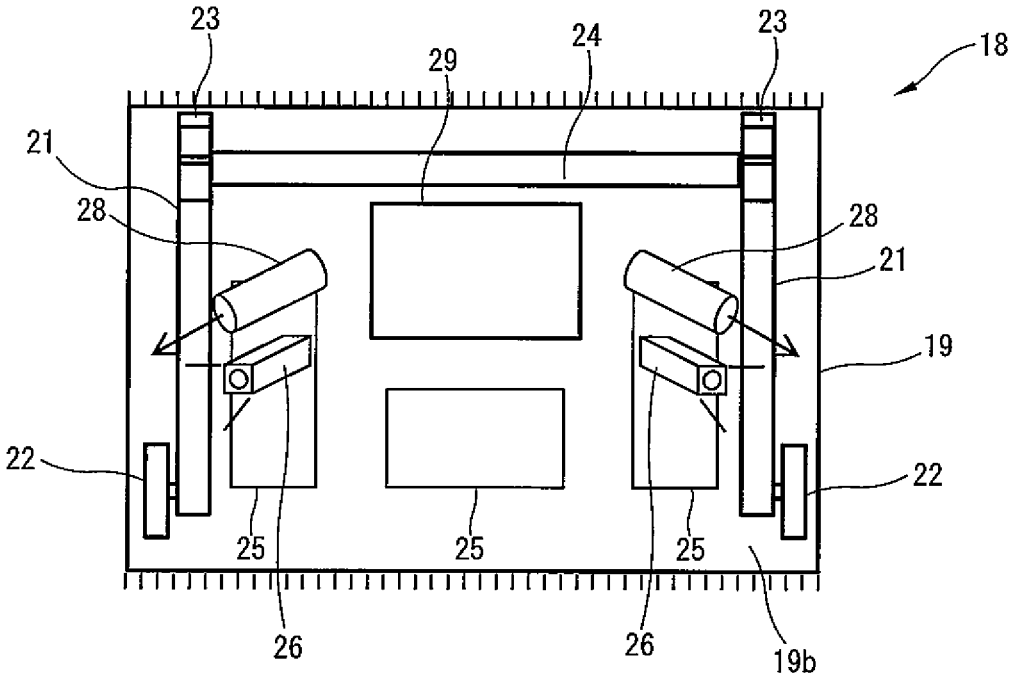
FIG. 4 is a bottom view of the diagnostic step of FIG. 2.

As shown in FIG. 3, the diagnostic step 18 may have a configuration which resembles escalator step 2 and includes a tread portion 19 joined to a riser portion 20 and step arms 21 (only one shown in FIG. 3) connecting the tread portion 19 to the riser portion 20 as known in the art. The step arms 21 are connected to each other by an axle 24 (FIG. 4) and may each comprise rollers 22 on one end for riding on a rail and support members 23 on the other end for engaging a transverse axle such that the diagnostic step 18 may be driven around the loop together with the escalator steps 2 when it is installed on the escalator. FIG. 3(*a*) shows a plan view, FIG. 3(*b*) shows a front view and FIG. 3(*c*) shows a side view of the diagnostic step 18.

The outer surface 19*a* of the tread portion 19 corresponds to the surface of escalator step 2 which receives the foot of a passenger and faces generally upward during the advance path. The tread portion 19 includes at least one maintenance window 25 (three in this example) for access to the inner side of the diagnostic step 18.

The diagnostic step 18 includes at least one camera 26, at least one directional microphone 28 and an analyzer unit 29 in the space defined by the tread portion 19, riser portion 20 and step arms 21. In the embodiment shown in FIG. 4, the diagnostic step 18 includes two cameras 26 and two microphones 28. Each camera 26 may be attached to the inner surface 19*b* of the tread portion 19 such as by brackets and may be adjustable to shoot different directions. Each camera 26 may include a LED light. In this embodiment, one camera is adjusted to shoot one or a plurality of components positioned on one lateral side (ex. the left-hand side of FIG. 2) and one camera is adjusted to shoot one or a plurality of components positioned on the other lateral side (ex. the right-hand side of FIG. 2) of the interior space of the truss 3. The directional microphones 28 may also be attached to the inner surface 19*b* of the tread portion 19 such as by brackets and may be adjustable to point to different directions. In this embodiment, one microphone 28 is adjusted to point to one or a plurality of components on the right-hand side and one microphone 28 is adjusted to point to one or a plurality of components positioned on the left-hand side of the interior space of the truss 3.

In this way, the cameras 26 and the microphones 28 may collect images or sounds of components positioned on the left-hand side and on the right-hand side separately. Such components may include components such as the handrail drive system 10 or sprocket wheels 6, 7. The cameras 26 and the microphones 28 may be adjusted through the maintenance windows 25 after installing the diagnostic step 18 onto the escalator.

Figure 5:
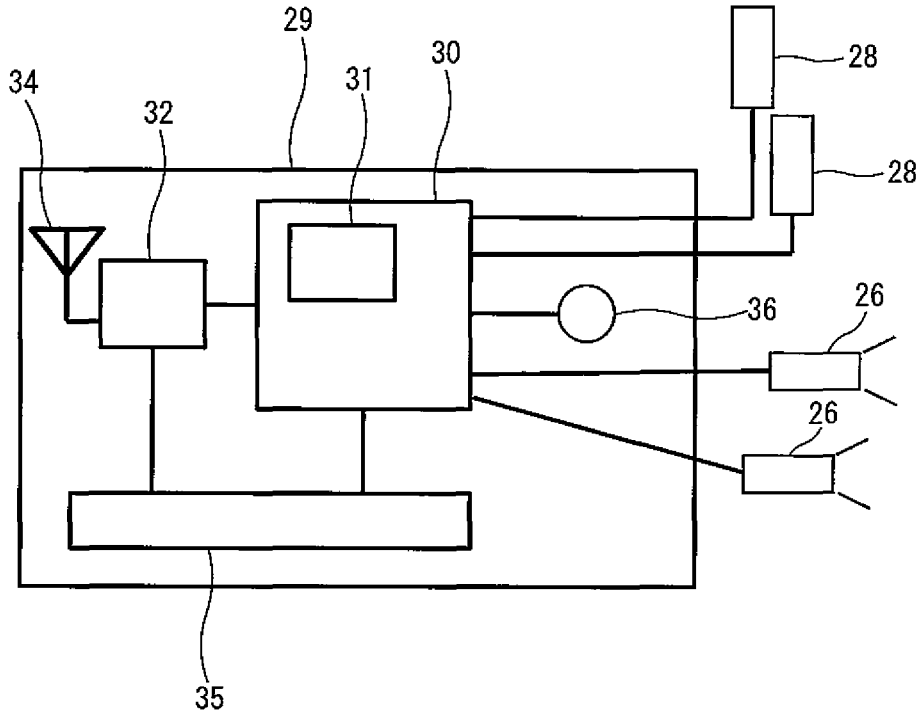
FIG. 5 is a detailed view of the analyzer unit of FIG. 4.

The analyzer unit 29 may be attached to the inner surface 19*b* of the tread portion 19. A detailed view of the analyzer unit 29 is shown in FIG. 5. The analyzer unit 29 may comprise a printed-circuit board 30 including a memory 31, a wireless network interface device 32 such as a 3G modem, WiFi interface etc. including an antenna 34 and a battery 35 for providing power to all of the components included in the diagnostic step 18. The directional microphones 28 and cameras 26 are connected to the printed-circuit board 30 to provide sound data and image data. An acceleration sensor 36 may also be connected to the printed-circuit board to provide acceleration data. The printed-circuit board 29 receives the analog data or digital data from the cameras 26, microphones 28 and sensor 36, converts analog data to digital data as necessary and stores such data in the memory 31. The sound data and image data are synchronized. The printed-circuit board 29 may further analyze such data. Data and analyzed results may be provided to a wireless network 38 (FIGS. 7 to 9) via the wireless network interface device 32.

In another embodiment, the camera 26 itself may include a memory or storage such as a SD card and a wireless network interface device such as a WiFi interface. Image data may be stored in the memory or storage and will be directly accessible through a wireless network.

Figure 6:
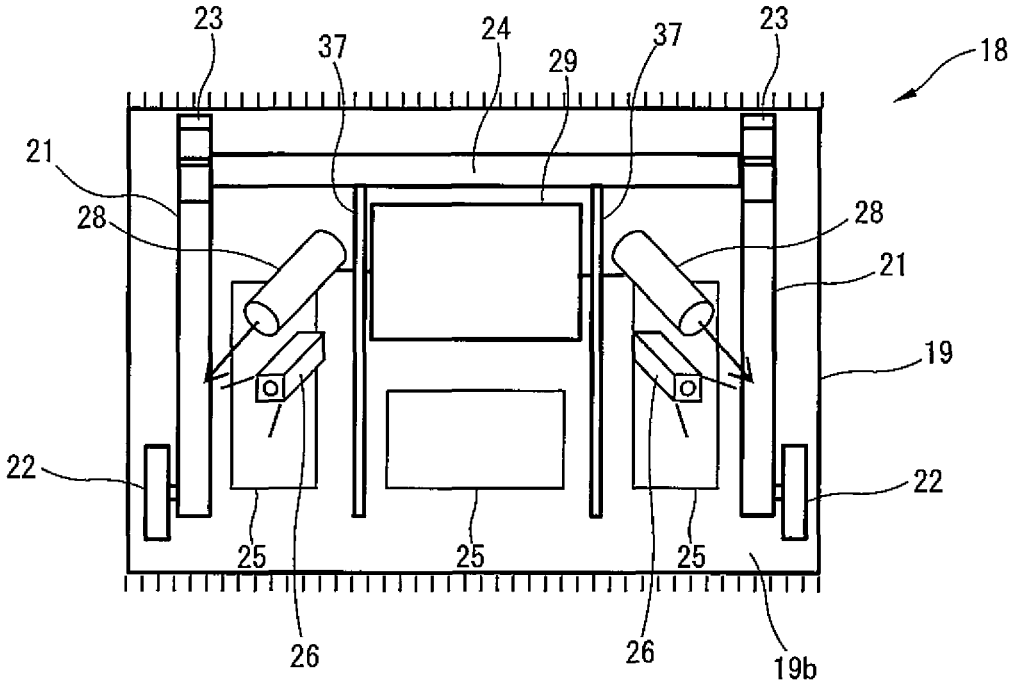
FIG. 6 is a bottom view of another embodiment of the diagnostic step of the present invention.

FIG. 6 shows a further embodiment in which partitions 37 are provided on the inside surface 19*b* of the tread portion 19 to separate sounds emanating from the right-hand side of the truss and sounds emanating from the left-hand side of the truss to allow a more precise collection of sounds. Two partitions 37 are provided in this embodiment. However, one partition 37 may be sufficient to separate sounds in other embodiments.

Figure 7:
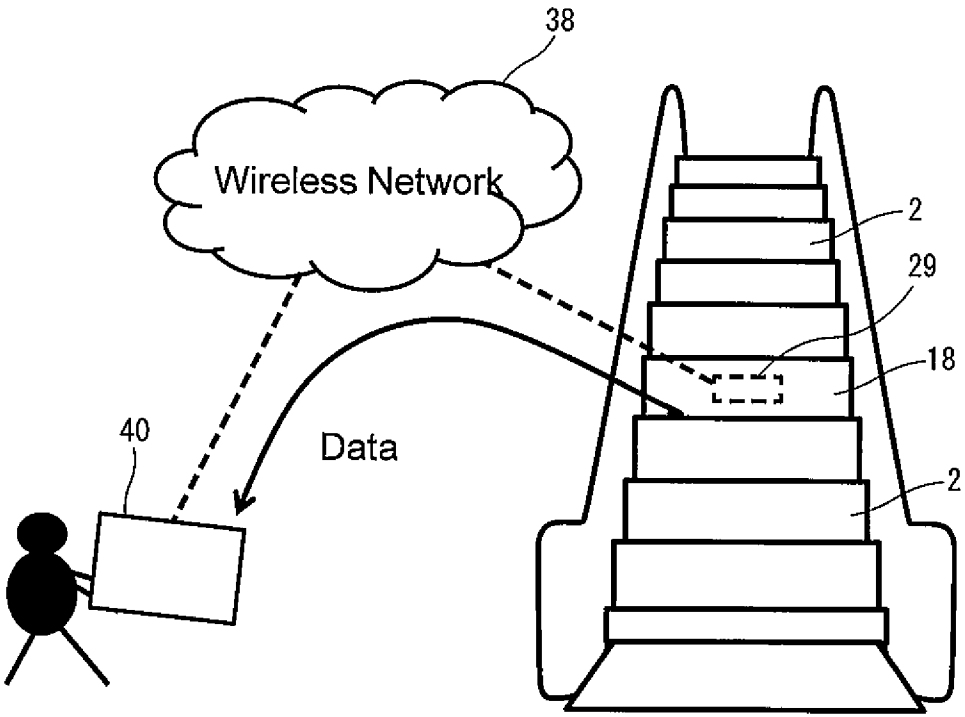
FIG. 7 is a schematic view of a wireless network connecting the analyzer unit and a personal computer.

With reference to FIG. 7, data may be transmitted to a personal computer 40 which may be in the form of a tablet, smart phone etc. via the wireless network 38. A service engineer may listen to the sounds emanating from the left-hand side of the truss 3 while viewing the corresponding image of the components positioned on the left-hand side of the truss 3 causing the sounds. The sounds and image may be switched to the right-hand side after checking the left-hand side. This allows the service engineer to easily find out which components, components positioned on the left-hand side or components positioned on the right-hand side, are causing abnormal sounds, in spite of sound reverberations inside the truss 3 and also allows the service engineer to visually check the components causing the abnormal sounds at the same time. This greatly shortens the time to determine the cause of failure or malfunctions associated with the escalator and does not require stopping the escalator and gaining access to the space beneath the escalator steps 2.

Figure 8:
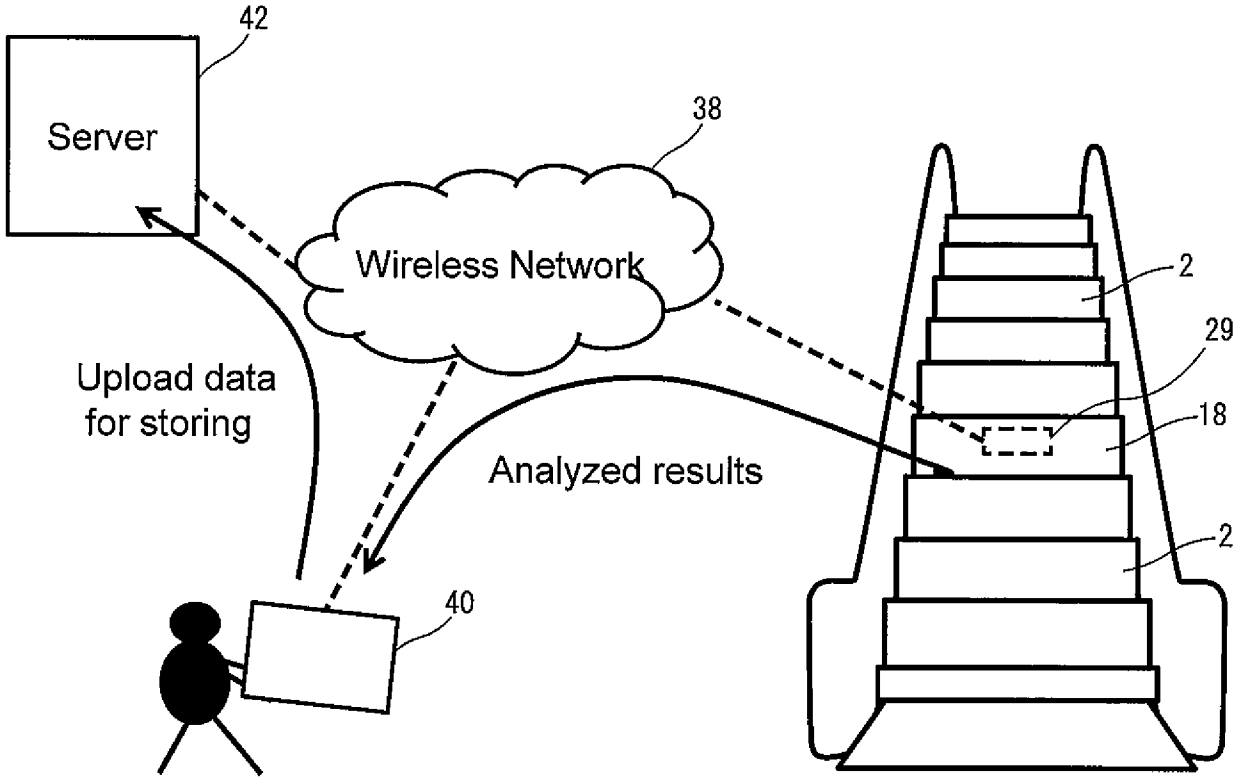
FIG. 8 is a schematic view of a wireless network connecting the analyzer unit, a personal computer and a server.

FIG. 8 shows another embodiment in which the analyzer unit 29 analyzes data from the microphone 28, camera 26 and/or sensor 36 and the analyzed results are transmitted to the personal computer 40 of the service engineer. The analyzed results may include the detection of abnormal sounds with corresponding images and may allow the service engineer to immediately determine the cause of failure or malfunctions associated with the escalator. The service engineer may upload such results to a server 42 for storage. The server 42 may be remote from the site and the stored data may be used for preventive maintenance. This process is carried out via a wireless network 38.

Figure 9:
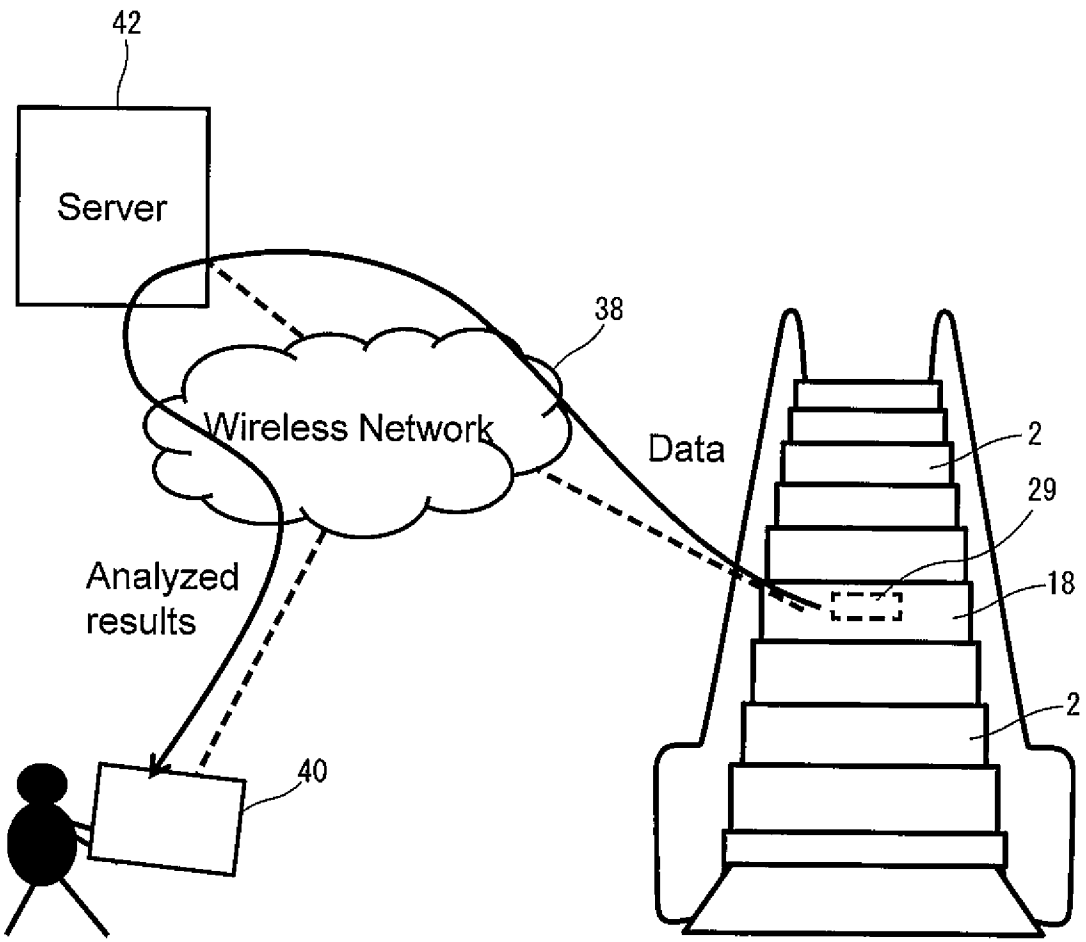
FIG. 9 is a schematic view of another example wireless network connecting the analyzer unit, a personal computer and a server.

FIG. 9 shows a further embodiment in which data and/or analyzed data is transmitted to a server 42. The server 42 may be remote from the site. The data is stored and may be further analyzed in the server 42. The stored data may be used for preventive maintenance. The server 42 may provide the further analyzed results to the personal computer 40 of the service engineer. This process is also carried out via a wireless network 38.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A diagnostic step for a passenger conveyor, comprising:

at least one camera for shooting at least one lateral side of an interior space of the passenger conveyor, wherein a first balustrade assembly is positioned at the at least one lateral side;

at least one directional microphone pointed to said at least one lateral side of the interior space of the passenger conveyor; and an analyzer unit which receives image data from the least one camera and sound data from the least one directional microphone and transmits the data to an outside network.

2. The diagnostic step of claim 1, wherein the at least one camera comprises two cameras with one camera shooting a first lateral side of the interior space of the passenger conveyor and the other camera shooting a second lateral side of the interior space of the passenger conveyor opposed to the first lateral side, wherein the first balustrade assembly is positioned at the first lateral side and a second balustrade assembly is positioned at the second lateral side; and wherein the at least one directional microphone comprises two microphones with one microphone pointed to the first lateral side of the interior space of the passenger conveyor and the other microphone pointed to the second lateral side of the interior space of the passenger conveyor.

3. The diagnostic step of claim 2, further comprising at least one partition for separating sounds emanating from the first lateral side and the second lateral side.

4. The diagnostic step of claim 1, wherein the diagnostic step comprises a rise portion and a tread portion, the least one camera, the least one directional microphone and the analyzer unit positioned in the space defined by the rise portion and the tread portion.

5. The diagnostic step of claim 4, wherein the tread portion includes at least one maintenance window.

6. The diagnostic step of claim 5, wherein the least one camera and the least one directional microphone are adjustable through the maintenance window.

7. The diagnostic step of claim 1, further comprising an acceleration sensor and wherein the analyzer unit receives acceleration data from the acceleration sensor and transmits the data to the outside network.

8. The diagnostic step of claim 1, further comprising a battery.

9. The diagnostic step of claim 1, wherein the analyzer unit comprises a wireless network interface including an antenna.

10. The diagnostic step of claim 1, wherein the analyzer unit includes a memory for storing data and the analyzer unit analyzes the stored data to provide analyzed results to the outside network.

11. The diagnostic step of claim 1, wherein the passenger conveyor is an escalator.

* * * * *